US005632806A

United States Patent [19]

Galassi

[11] Patent Number: 5,632,806

[45] Date of Patent: May 27, 1997

[54] INTEGRATED SUCTION HOOD FEATURING AIR DEPOLLUTION

[75] Inventor: Alvaro Galassi, Purello, Italy

[73] Assignee: Faber S.p.A., Fabriano, Italy

[21] Appl. No.: 595,109

[22] Filed: Feb. 1, 1996

[30] Foreign Application Priority Data

Feb. 17, 1995 [IT] Italy ..... B095U0027

[51] Int. Cl.[6] ..... B03C 3/016

[52] U.S. Cl. ..... 96/16; 55/279; 55/DIG. 36; 96/55; 96/63; 422/24

[58] Field of Search ..... 96/16, 62, 97, 96/55, 63, 26, 18, 81, 57–59; 55/279, DIG. 36; 422/24, 121

[56] References Cited

U.S. PATENT DOCUMENTS

| | | | |
|---|---|---|---|
| 2,651,383 | 9/1953 | Yonkers, Jr. | 96/16 |
| 2,709,954 | 6/1955 | Baker | 96/16 X |
| 3,299,620 | 1/1967 | Hollingworth | 55/279 X |
| 3,518,046 | 6/1970 | Cicirello | 55/279 X |
| 3,576,593 | 4/1971 | Circirello | 55/279 X |
| 4,102,654 | 7/1978 | Pellin | 55/279 X |
| 4,118,191 | 10/1978 | Bohnensieker | 422/121 X |
| 5,185,015 | 2/1993 | Searle | 422/121 X |
| 5,225,167 | 7/1993 | Wetzel | 422/24 X |
| 5,330,722 | 7/1994 | Pick et al. | 96/55 X |
| 5,492,557 | 2/1996 | Vanella | 96/62 X |

*Primary Examiner*—Richard L. Chiesa
*Attorney, Agent, or Firm*—Guido Modiano; Albert Josif

[57] ABSTRACT

The suction hood has an air depollution apparatus that is associated therewith and includes, inside a container that is connected to an intake grille in a downward region and to a discharge grille in an upward region, a mechanical filter, an activated-charcoal filter, suction fans that are adapted to produce a flow of air, and a collection device. The collection device includes, in succession: an electrification grid, which is supplied at a high voltage with negative polarity and is arranged on a horizontal plane that lies transversely to the container; a partition, which is arranged at an angle in front of the electrification grid so as to convey the stream of air toward at least one region that has a narrower cross-section; a negatively-charged deflector plate and a positively-charged collector plate that are arranged vertically so as to face each other at a short distance, so as to delimit the respective above- mentioned region having a narrower cross-section. A germicidal lamp is arranged at an opening of the deflector plate and is adapted to illuminate the collector plate substantially over its entire length, along a direction that lies transversely to the container.

9 Claims, 3 Drawing Sheets

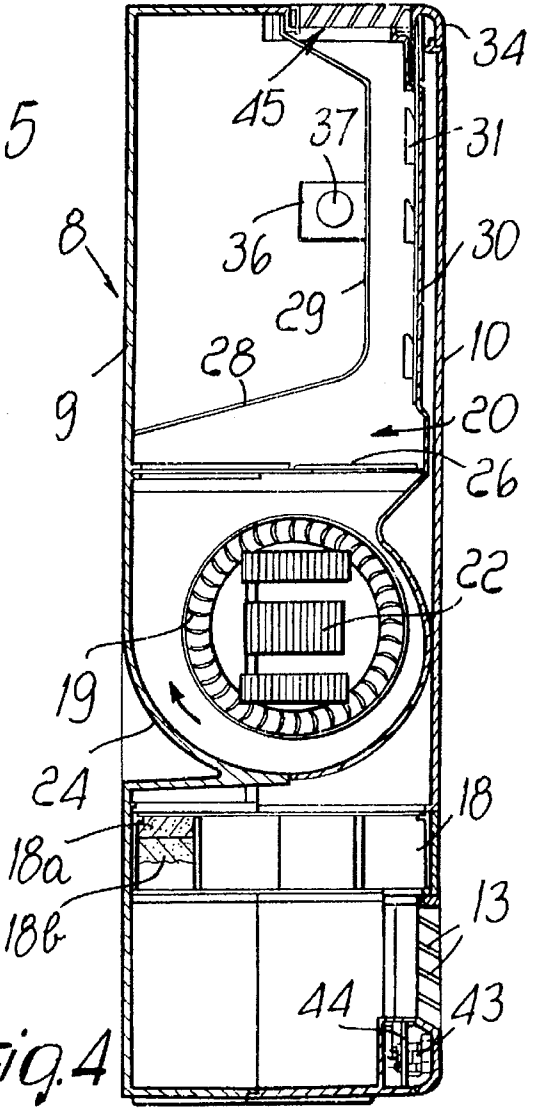
Fig. 4
Fig. 5
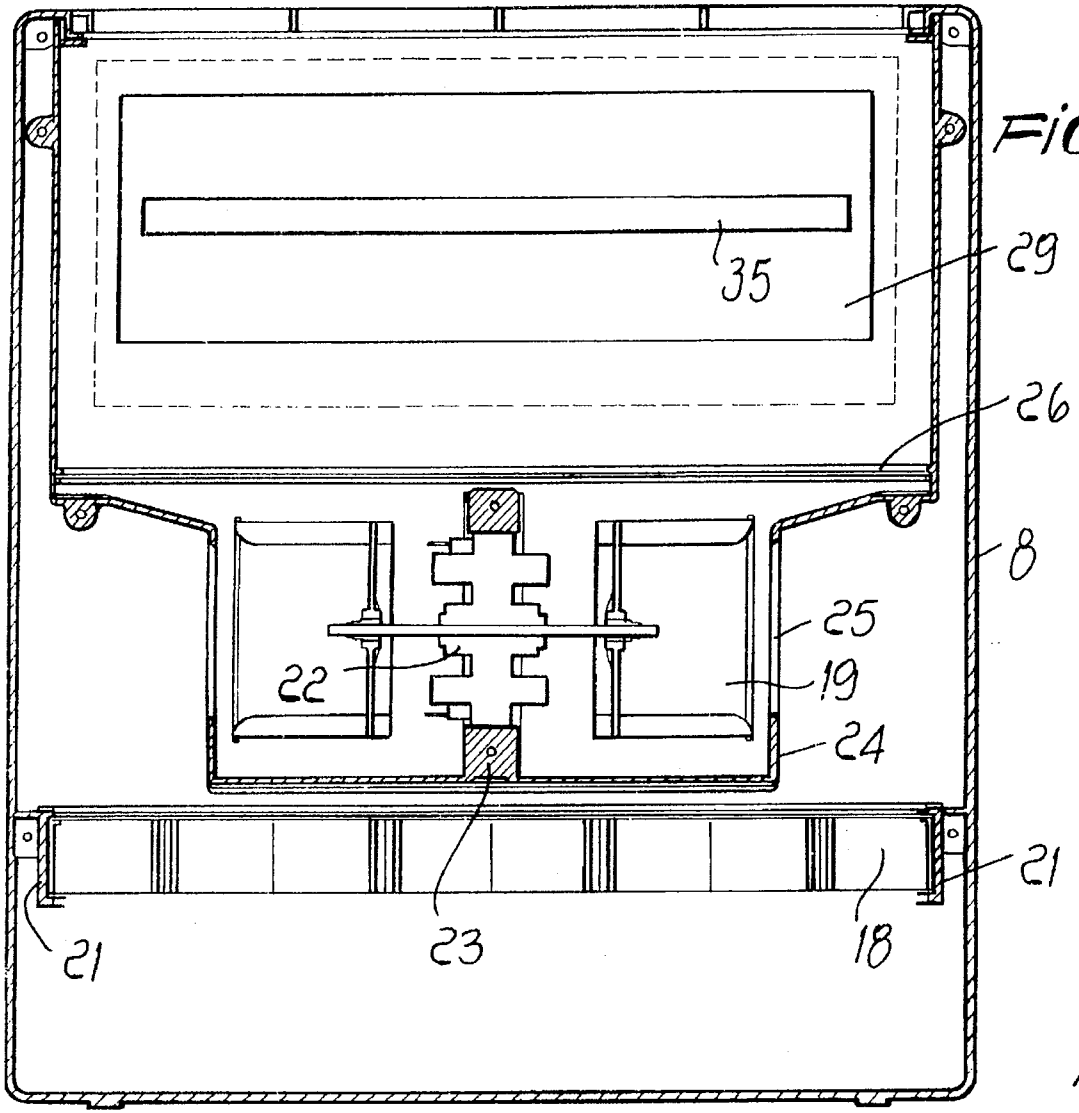

INTEGRATED SUCTION HOOD FEATURING AIR DEPOLLUTION

BACKGROUND OF THE INVENTION

The present invention relates to an integrated suction hood featuring depollution of air from fumes, dust, toxic gases, viruses, bacteria, and the like.

It is known that living spaces are affected by various forms of pollution, such as industrial emissions, emissions produced by traffic and by heating systems, fumes, and the like.

In particular, the kitchen is one of the most polluted rooms of an apartment, since it is affected by the diffusion not only of the noxious factors originating from outside but also of those produced by food cooking and gas combustion. For example, the evaporation of water, which is rich in chlorine and other highly volatile noxious components, considerably contributes to pollution of the environment.

Venting hoods, which are fitted with a fan and connected to an external discharge duct, or recirculation hoods, which comprise an activated-charcoal filter, are commonly used to eliminate odors and noxious factors produced by cooking. These conventional hoods, however, are unable to eliminate all the pollutants that are present in the environment and can, on the contrary, lead to the development of bacterial colonies.

On the other hand, the filters that are currently available for purifying air from pollutants operate according to various physical principles (for example mechanical, chemical, or electrostatic principles) and are unable to eliminate pathogenic germs from the air and to block smaller particles, for example those measuring less than one tenth or one hundredth of a micron.

It is also known that in addition to air purity, an important factor for physical well-being is constituted by the presence, in the air itself, of negative ions, which are produced by solar radiation, by moving water masses, and by trees. Air ionization, however, is very limited in closed spaces, both due to pollution and due to appliances such as air-conditioning units and the like.

SUMMARY OF THE INVENTION

The aim of the present invention is to solve the mentioned problem by providing a suction hood which, in addition to eliminating kitchen odors and the like, allows to perform total depollution of the air, particularly blocking even the smallest particles and eliminating toxic gases and pathogenic germs.

Within the scope of this aim, an object of the present invention is to provide an integrated suction hood featuring air depollution, that is simple in concept, safely reliable in operation, and versatile in use.

This aim and this object are both achieved, according to the invention, by the present integrated suction hood featuring air depollution, characterized in that an air depollution apparatus is associated therewith and comprises, inside a container that is connected to an intake grille in a downward region and to a discharge grille in an upward region, a mechanical filter and an activated-charcoal filter mounted side by side on a frame that is inserted inside said container, above said intake grille, so that it can be extracted along a horizontal plane that lies transversely to said container; suction means that are arranged above said extractable frame and are adapted to produce a flow of air inside said container; a collection device that is arranged above said suction means and includes, in succession, an electrification grid that is supplied at a high voltage with negative polarity and is arranged on a horizontal plane that lies transversely to said container, a partition that is arranged at an angle in front of said electrification grid so as to convey the stream of air toward at least one region that has a narrower cross-section, a negatively charged deflector plate and a positively charged collector plate that are arranged vertically so as to face each other at a short distance, so as to delimit a respective above-mentioned region having a narrower cross-section; a germicidal lamp that is arranged at an opening of said deflector plate and is adapted to illuminate said collector plate substantially over its entire length, along a horizontal direction.

BRIEF DESCRIPTION OF THE DRAWINGS

The characteristics of the invention will become apparent from the detailed description of a preferred embodiment of the integrated suction hood featuring air depollution, illustrated only by way of non-limitative example in the accompanying drawings, wherein:

FIG. 4 is a longitudinal median sectional view of said apparatus;

FIG. 5 is a sectional view of said apparatus, taken along a vertical plane that lies transversely to the plane of FIG. 4;

DESCRIPTION OF THE PREFERRED EMBODIMENTS

Figure 2:
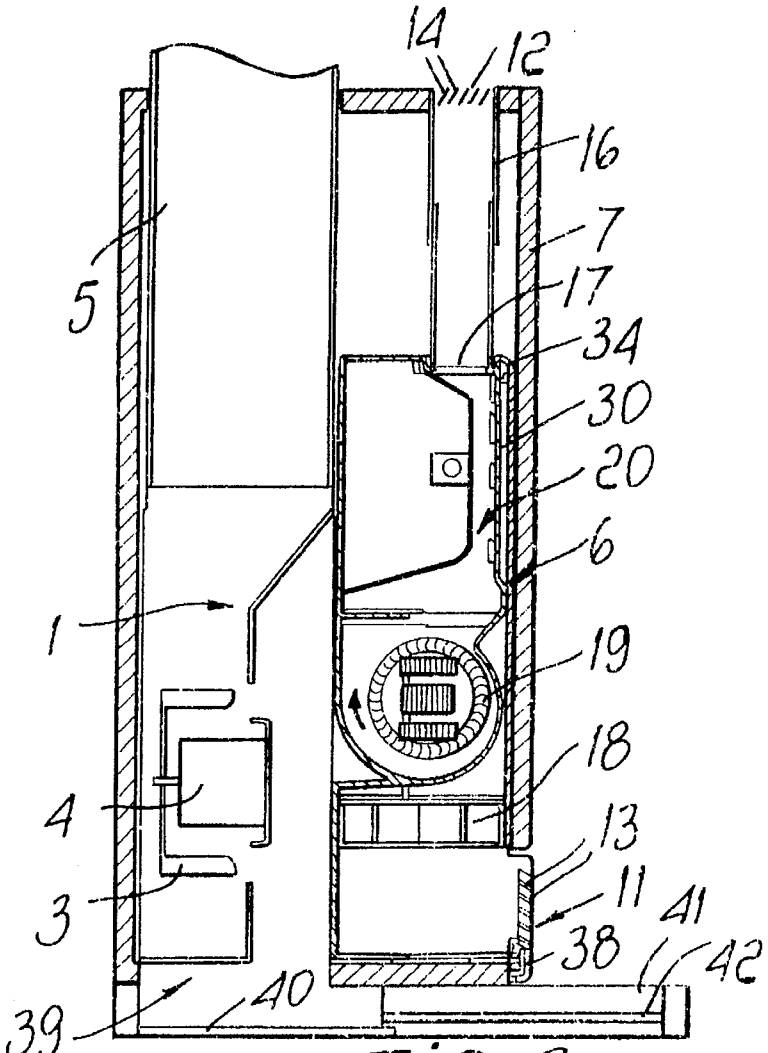
FIG. 2 is a longitudinal sectional view of said suction hood.
Figure 1:
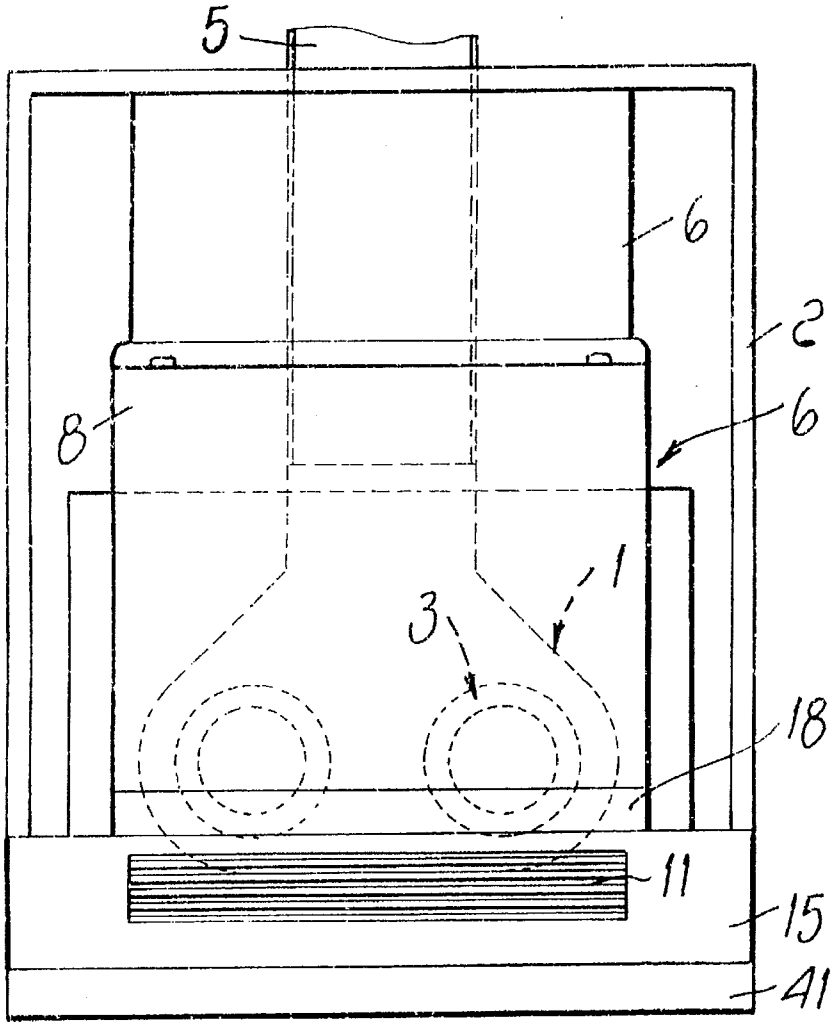
FIG. 1 is a front view of the integrated suction hood featuring air depollution.

With particular reference to the above figures, the reference numeral 1 designates a suction hood that is inserted in a suspended wall unit 2 for kitchens. The hood 1 is provided with two fans 3 that are driven by corresponding electric motors 4 and are meant to produce a stream of air; the hood 1 is connected to a discharge duct 5 that is connected to the outside for venting the aspirated air.

An air depollution apparatus, generally designated by the reference numeral 6, is located in front of the hood 1, inside the wall unit 2. The apparatus 6 is normally concealed by a door 7 of the wall unit 2, which can be opened for ordinary maintenance operations and the like.

The apparatus 6 has a container 8 that has a substantially vertical main dimension. Said container 8 is formed by a rear body 9 and by a front cover 10, which are associated at a vertical joining plane.

The wall unit 2 has an air intake grille 11 at the lower part of the front face, below the door 7, and a discharge grille 12 at the upper face. The grilles 11 and 12 are provided with vanes 13 and 14 that are appropriately inclined to direct the air stream and are connected to the container 8 of the apparatus 6.

More particularly, the intake grille 11 is provided in a lower band 15 of the wall unit, in front of a front opening of the container 8, and its vanes 13 are inclined with respect to the outer surface, so as to make the air stream converge toward the inside of said container 8 (see FIG. 4 in particular).

The discharge grille 12 is instead connected, through a telescopic duct 16, to an opening 17 of the upper face of the container 8, and its vanes 14 are inclined so as to direct the outgoing stream in a direction that lies in front of the suction hood. The telescopic duct 16 has a rectangular transverse cross-section, which in practice corresponds to that of the grille 12, and its length is adjustable according to the different heights that the wall unit 2 can assume.

The grilles 11 and 12 have, in practice, a main dimension that is equal to the width of the container 8 and are adapted to convey a large stream of air through said container 8.

A frame 18 for supporting a mechanical filter 18*a*, preferably of the fabric type, and an activated-charcoal filter 18*b*, a pair of fans 19 meant to produce the air stream, and a collection device 20 are arranged in series inside the container 1.

For obvious reasons of apparatus compactness, said elements are arranged so that they are mutually adjacent. Actually, any appropriate distance may be provided between said elements without compromising the depolluting action of the apparatus.

The frame 18 is adapted to be inserted between two guides 21 that are shaped inside the container 8, along a horizontal plane that lies transversely to said container. The frame 18 can be extracted from the container 8, along said guides 21, for the periodic operations for cleaning or replacing the mechanical filter and the activated-charcoal filter.

The fans 19 are supported symmetrically by an electric drive unit 22 along a horizontal rotation axis. The electric motor 22 is fixed to a dividing wall 23 the shape whereof follows a median vertical plane of the container 8; said dividing wall 23 divides a casing 24 for containing the fans 19 that is open in an upward region and is laterally provided with circular openings 25 that are adapted to channel the air stream.

The collection device 20 has an electrification grid 26 that is supplied at a high voltage with negative polarity and is arranged above the casing 24 of the fans 19, on a horizontal plane that lies transversely to the container 8. The electrification grid 26 is formed by a plurality of punch-outs 27 evenly provided on a metal plate.

Figures 3, 6:
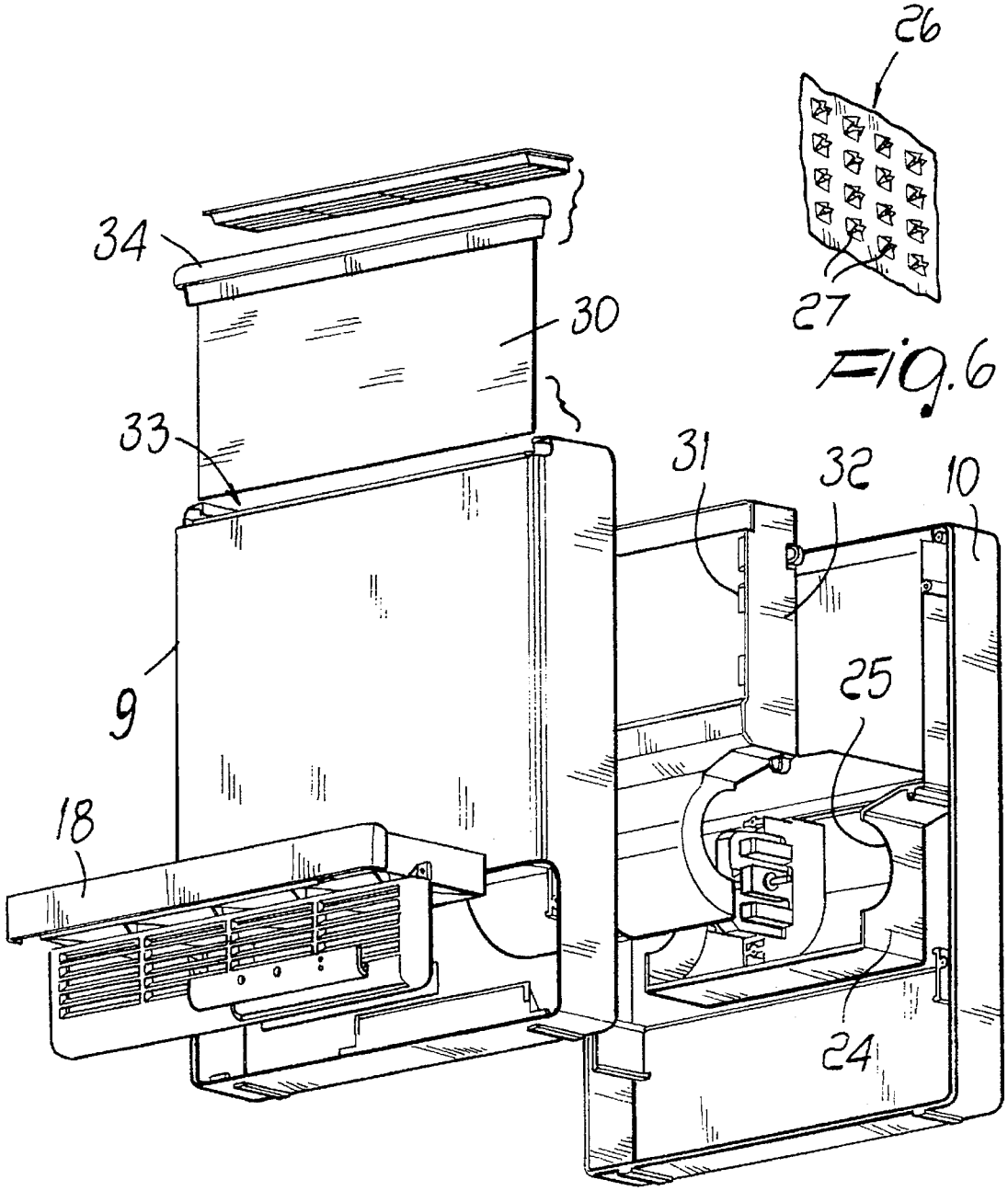
FIG. 3 is an exploded perspective view of said air depollution apparatus.
FIG. 6 is a view of a detail of said electrification grid.

As shown in detail in FIG. 6, the punch-outs 27 form a plurality of sharp protrusions, practically shaped like ashlars, that form respective points at the vertex of blades, so as to increase the electron emission phenomenon. Moreover, no ozone is formed.

A partition 28 made of plastics is arranged in front of the electrification grid 26 and is inclined so as to convey the air stream toward the upper part of the container 8. The partition 28 is provided with a deflector plate 29 that is rigidly coupled thereto on a vertical plane that lies parallel to the front one, and a negative polarity is applied to said plate.

A positively-charged collector plate 30 is arranged so as to frontally face the deflector plate 29 at a short distance; the plates 29 and 30 delimit a narrower region of the passage section of the air stream.

The collector plate 30 is slideably mounted on vertical guides 31 that are formed on the sides of the container 8 by a framework 32 that forms in practice a continuation of the casing 24 of the fans 19. The plate 30 can be removed through an upper opening 33 of the cover of the container, by means of a corresponding handle 34, for the periodic cleaning operations.

Conveniently, along one of the guides 31 there are two contacts, not shown, that are adapted to alternately abut against the collector plate 30 and are respectively meant to supply voltage to said collector plate 30, in the position for insertion inside the container 8, and to take off voltage from said plate 30, when it is extracted. A microswitch is furthermore adapted to indicate the correct insertion of the collector plate 30 inside the container 8.

The deflector plate 29 has an opening 35 that runs in practice along its entire width. A housing 36 is fixed to the side of said opening 35 and is adapted to act as a seat for a UV neon lamp 37 that has a germicidal function; the lamp 37 is of the type without ozone emission. The housing 36 is made of metallic material the internal surface whereof is polished, so as to act as a paraboloid for reflecting light.

Conveniently, the collector plate 30 is made of satin-finished steel, so as to avoid reflecting the light emitted by the lamp 37. The execution of the collector plate 30 and of the housing 36 in metal also ensures that the UV rays generated by the lamp 37 do not produce crystallization and emission of noxious gases on the part of the plastics of which the container 8 and the partition 28 are made; the guides 31 and the handle 34 are also made of plastic materials and therefore provide electrical insulation.

Furthermore, the apparatus 6 conveniently has an ionizing element 45, that is constituted in a known manner by a head with a double point for the emission of negative ions, arranged along the output air stream. The intensity of the ionization is conveniently adjustable by means of a regulator 43 located on the control panel 44 of an electronic unit for controlling the apparatus, which is arranged at an L-shaped strip 38 that lies below the intake grille 11.

Below the hood 1, the wall unit 2 is provided with an opening 39 that is meant for air intake; said opening 39 lies substantially along the entire width of the wall unit 2, on its lower surface.

The opening 39 is faced, toward the outside, by a mechanical filter 40, above which the wall unit slidingly supports a pull-out ledge 41 that forms the support for an additional mechanical filter 42. The extraction of the ledge 41 allows in practice to double the extension of the mechanical filter that is arranged on a horizontal plane above the cooking range.

The operation of the apparatus is easily understandable from the above description.

The extraction of the ledge 41, which makes the mechanical filter 40, 42 available, causes the activation of the suction hood, activating the fans 3, which aspirate air in the region that lies above the cooking range and convey it outside through the discharge duct 5. During this step, the air depollution apparatus 6 is instead inactive.

Instead, when the ledge 41 is inserted inside the volume of the wall unit 2, in the retracted position, the fans 3 of the suction hood are stopped automatically, whereas the fans 19 of the air depollution apparatus 6 are activated. The fans 19 generate a stream of air that passes through the apparatus 3, moving from the intake grille 11 to the discharge grille 12.

The air stream produced by the fans 19 passes, in sequence, through the mechanical filter and the activated-charcoal filter that are mounted on the frame 18 and through the collection device 20. The mechanical filter is adapted to retain particles larger than 200 microns, whereas the activated-charcoal filter is capable of retaining the toxic gases that are present in the air.

The collection device 20 has the purpose of blocking all smaller particles, down to sizes of less than 0.001 microns, as well as viruses, bacteria, and similar microorganisms (spores, molds, yeasts, algae) that are present in the air. For this purpose, the electrification grid 26 supplied with negative voltage electrifies said particles carried by the air stream that passes through it; this electrification is produced by the emission of electrons from the points and from the blades of the punchouts 27 of the grid 26.

The air stream is deflected by the partition 28 and is conveyed into the reduced-section region formed between the deflector plate 29 and the collector plate 30. At this region, the particles charged negatively by the electrification grid 26 are repelled by the deflector plate 29, which is likewise negatively charged, toward the collector plate 30, which instead attracts them, since it is positively charged. The particles and the microorganisms therefore deposit on the collector plate 30.

The particulate that is deposited on the collector plate 30 is illuminated by the UV germicidal lamp 37, which thus kills the microorganisms that are present in said particulate.

The fact should be stressed that the irradiation energy of the lamp 37 per unit surface is very high, in view of the short distance between said lamp 37 and the collector plate 30, and that the irradiation time is very long, since the microorganisms are motionless on the collector plate 30. This ensures complete inactivation of the microorganisms.

The fact should also be stressed that the germicidal lamp 37 is constituted by a neon tube the length whereof is essentially equal to that of the collector plate 30, so as to illuminate the entire plate 30. The germicidal lamp 37 also acts directly on the particulate that is collected on the plate 30, without the interposition of glass plates or the like.

To conclude, the described suction hood effectively replaces conventional venting hoods, which are provided with a fan and connected to an external discharge duct, or recirculation hoods, which comprise an activated-charcoal filter. The suction hood according to the invention in fact allows to vent externally the fumes and odors produced during cooking, whereas when said hood is not active, the apparatus that performs air depollution is activated automatically.

Said apparatus allows to perform total depollution of the air in the room, blocking even the smallest particles and eliminating toxic gases and pathogenic germs. The ionizer also enriches the clean output air with negative ions, in an appropriately adjustable manner, so as to increase the attainable benefits.

The fact should be stressed that the arrangement of the air depollution apparatus with respect to the suction hood can be different from the one described above by way of non-limitative example.

In particular, for example, the air depollution apparatus can be arranged to the rear of the hood or can be integrated in one of the walls of said hood.

In the practical execution of the invention, the materials employed, as well as the shape and the dimensions, may be any according to the requirements.

What is claimed is:

1. In an integrated suction hood, an air depollution apparatus comprising: a container being connected to an intake grille in a downward region thereof and to a discharge grille in an upward region thereof; a mechanical filter and an activated-charcoal filter, said mechanical and activated-charcoal filters being mounted side by side on a frame that is inserted inside said container, above said intake grille, said frame being extractable from, and along a horizontal plane that lies transversely to said container; suction means being arranged above said extractable frame, said suction means being adapted to produce a flow of air inside said container; a collection device being arranged above said suction means, said collection device including, in succession, an electrification grid being supplied at a high voltage with negative polarity and arranged on a further horizontal plane lying transversely to said container, a partition being arranged at an angle in front of said electrification grid so as to convey the flow of air toward at least one region having a narrower cross-section, a negatively-charged deflector plate and a positively-charged collector plate, said deflector and collector plates being arranged vertically so as to face each other at a short distance for delimiting said region having a narrower cross-section; and a germicidal lamp being arranged at an opening of said deflector plate, said lamp illuminating said collector plate substantially over its entire length, along a horizontal direction.

2. The hood of claim 1, wherein said air depollution apparatus is arranged, in front of said hood, inside a suspended wall unit, said wall unit being provided, in a downward region, with an air intake, said air intake being frontally faced, and separated from outside environment, by a mechanical filter, a pull-out ledge being slidingly supported above said filter, said ledge forming a support of an additional mechanical filter, and extraction of said ledge from above said filter causing activation of suction means of said hood, as an alternative to activation of said air depollution apparatus.

3. Hood according to claim 2, wherein said intake grille is arranged at a lower part of a front face of said wall unit, said intake grille being provided with vanes, said vanes being inclined with respect to said wall unit outer surface, so as to make incoming air flow converge inside said container of the air depollution apparatus.

4. Hood according to claim 2, wherein said discharge grille is arranged at an upper face of said wall unit and is connected to said container of the air depollution apparatus through a telescopic duct, said discharge grille being provided with vanes, said vanes being inclined with respect to said wall unit outer surface, so as to direct outgoing air flow toward a front region of said hood.

5. The hood of claim 1, wherein said suction means have two fans, said fans being symmetrically supported, along a horizontal rotation axis, by an electric drive unit, said drive unit being fixed to a dividing wall that lies in a vertically median position with respect to a casing for accommodating said fans, said casing being open in an upward region and being laterally provided with circular openings for channelling said air flow.

6. The hood of claim 1, wherein said collector plate is slideably mounted on vertical guides, said guides being formed on sides of said container, said collector plate being extractable from an upper opening of said container by pulling on a corresponding handle.

7. The hood of claim 1, wherein said air depollution apparatus has a housing, said housing being fixed to a side of said opening where said deflector plate lies, along an entire width of said plate, said housing acting as a seat for said germicidal lamp, and being made of a metallic material the internal surface whereof is polished so as to act as a paraboloid for reflecting light emitted by said germicidal lamp, said lamp comprising a UV-ray lamp.

8. The hood of claim 1, wherein said air depollution apparatus has an ionizing element, said ionizing element being arranged to interfere with output air flow, the ionizing element being comprised of a head with two points for emitting negative ions, intensity of ionization being adjustable through a regulator that is located on a control panel of an electronic unit for controlling said apparatus, said unit being arranged at an L-shaped strip that lies below said intake grille.

9. The hood of claim 1, wherein said electrification grid has a uniform plurality of punch-outs that are formed on a metallic plate, said punch-outs providing a plurality of sharp raised portions that are substantially ashlar shaped and form respective points at vertices of corresponding blades.

* * * * *